US006137466A

United States Patent [19]

Moughanni et al.

[11] Patent Number: 6,137,466

[45] Date of Patent: Oct. 24, 2000

[54] LCD DRIVER MODULE AND METHOD THEREOF

[75] Inventors: Claude Moughanni; Kenneth Robert Burch, both of Austin; William C. Moyer, Dripping Springs, all of Tex.

[73] Assignee: Motorola, Inc., Schaumburg, Ill.

[21] Appl. No.: 08/963,494

[22] Filed: Nov. 3, 1997

[51] Int. Cl.[7] ..... G09G 3/36

[52] U.S. Cl. ..... 345/99; 345/94; 345/100

[58] Field of Search ..... 345/87, 98, 99, 345/100, 103, 206, 214, 211, 94

[56] References Cited

U.S. PATENT DOCUMENTS

| | | | |
|---|---|---|---|
| 4,748,444 | 5/1988 | Arai | 345/99 |
| 5,311,206 | 5/1994 | Nelson | 345/89 |
| 5,319,381 | 6/1994 | Mourey et al. | 345/100 |
| 5,394,166 | 2/1995 | Shimada | 345/98 |
| 5,420,604 | 5/1995 | Scheffer et al. | 345/100 |
| 5,448,260 | 9/1995 | Zenda et al. | 345/100 |
| 5,508,716 | 4/1996 | Prince et al. | 345/100 |
| 5,543,947 | 8/1996 | Mase et al. | 359/84 |
| 5,592,193 | 1/1997 | Chen | 345/102 |
| 5,598,565 | 1/1997 | Reinhardt | 713/323 |
| 5,867,140 | 2/1999 | Rader | 345/98 |
| 5,881,299 | 3/1999 | Nomura et al. | 713/324 |
| 5,926,173 | 6/1999 | Moon | 345/211 |

OTHER PUBLICATIONS

Motorola, Inc., "Product Preview LCD Segment Driver MC141518", Motorola Semiconductor Technical Data, Rev 2.1, pp. 2–13, Sep. 1993.

Motorola "MC68328 (Dragonball) Integrated Processor User's Manual", pp. 4–1 through 4–20 (1995).

Motorola, Inc., "Advance Information LCD Segment Driver CMOS MC141511", Motorola Semiconductor Technical Data, Rev. 4, Dec. 1994.

Motorola, Inc. "Product Preview LCD Segment/Backplane Driver LSC14138", Motorola Semiconductor Technical Data, Rev. 2.2, Aug. 1, 1994.

OKI Semiconductor, "Advanced LCD Controller/Driver Family Products", Family Data Sheet Display Driver Products, pp. 3–1 through 3–18, 4–1 through 4–10, and 2–10 through 2–15, Jul. 1994.

Motorola, Inc., "Product Preview LCD Backplane Driver MC141512 MC141515", Motorola Semiconductor Technical Data, Rev 2.3, pp. 2–11, Feb. 1994.

Motorola, Inc., "Product Preview LCD Backplane Driver MC141516", Motorola Semiconductor Technical Data, Rev 2.3, pp. 2–8, Sep. 1994.

*Primary Examiner*—Kent Chang

[57] ABSTRACT

A method for driving a multiplexed LCD panel (38). An LCD controller (20) controls the LCD panel (38) and provides a low power mode which refreshes a subset of the display panel (40) sequentially while refreshing the rest of the panel (38) in parallel. By resolving the panel into these portions, the present invention reduces the power consumption of an LCD module. Display information is stored in a memory (12) and provided to the controller (38) which drives the LCD panel (38). A reset signal eliminates fetching and clocking of zeroes for common areas in the display. One embodiment bit fills to provide a two tone display in low power mode.

27 Claims, 5 Drawing Sheets

LOW POWER WINDOW LOCATION AND SIZE

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| R4 | R3 | R2 | R1 | R0 | 0 | 0 | V8 | V7 | V6 | V5 | V4 | V3 | V2 | V1 | V0 |

| 31 | 30 | 29 | 28 | 27 | 26 | 25 | 24 | 23 | 22 | 21 | 20 | 19 | 18 | 17 | 16 |
|---|---|---|---|---|---|---|---|---|---|---|---|---|---|---|---|
| 0 | 0 | 0 | 0 | 0 | 0 | C9 | C8 | C7 | C6 | C5 | C4 | C3 | C2 | C1 | C0 |

FIG.2

WINDOW DATA

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| A15 | A14 | A13 | A12 | A11 | A10 | A9 | A8 | A7 | A6 | A5 | A4 | A3 | A2 | A1 | A0 |

| 31 | 30 | 29 | 28 | 27 | 26 | 25 | 24 | 23 | 22 | 21 | 20 | 19 | 18 | 17 | 16 |
|---|---|---|---|---|---|---|---|---|---|---|---|---|---|---|---|
| A31 | A30 | A29 | A28 | A27 | A26 | A25 | A24 | A23 | A22 | A21 | A20 | A19 | A18 | A17 | A16 |

FIG.3

LOW POWER MODE CONTROL REGISTER

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| MS3 | MS2 | MS1 | MS0 | 0 | LVE | 0 | BW | LME | UR6 | UR5 | UR4 | UR3 | UR2 | UR1 | UR0 |

| 31 | 30 | 29 | 28 | 27 | 26 | 25 | 24 | 23 | 22 | 21 | 20 | 19 | 18 | 17 | 16 |
|---|---|---|---|---|---|---|---|---|---|---|---|---|---|---|---|
| 0 | 0 | 0 | 0 | MN3 | MN2 | MN1 | MN0 | 0 | 0 | 0 | 0 | 0 | 0 | CPM | CBM |

FIG.4

LOW POWER COMMAND REGISTER

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | LPE |

| 31 | 30 | 29 | 28 | 27 | 26 | 25 | 24 | 23 | 22 | 21 | 20 | 19 | 18 | 17 | 16 |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |

FIG.5

LCD DRIVER MODULE AND METHOD THEREOF

REFERENCE TO CO-PENDING APPLICATION

The present application is related to the following U.S. patent application:

"Display Driver Having a Low Power Mode," invented by Eytan Hartung et al., Attorney Docket No. PTO-2468U, filed Jan. 13, 1997 and assigned to the assignee hereof.

FIELD OF THE INVENTION

This invention relates to a liquid crystal display (LCD), and more particularly to an LCD system which minimizes power consumed during operation.

BACKGROUND OF THE INVENTION

Portable wireless communication devices such as pagers, mobile (cellular) telephones, Personal Digital Assistants (PDAs) are all required to consume as little power as possible during operation as each is battery operated. Because such devices use batteries which have a limited lifetime, it is desirable to extend the battery lifetime as far as possible before requiring replacement or recharge. As each of these portable, wireless communication devices generally includes an LCD, the power consumed in the LCD has often been evaluated.

Graphical LCD displays such as those used on portable, wireless communication devices, are also referred to as multiplex ed LCDs. Simple non-multiplexed LCDs have separate external connections for each and every segment plus a common back plane. Multiplexed LCDs have segments arranged at intersections of an x-y grid. The x-y grid is formed by an array of the rows and columns used to implement the LCD display. The arrangement of such segments is done to greatly reduce the number of external connections and increase potential display density.

LCD controllers are often used to control the operation of the LCD display and supply the display drivers with data. There are many different configurations of LCD controllers in existence. Currently, most LCD controllers require pixel-based graphical data to be fetched from a memory circuit in a repetitive and cyclical fashion. In fetching the pixel-based graphical data, enough data for the whole display is retrieved. Furthermore, to prevent flickering of the LCD display, the data must be provided to the LCD display by the LCD controller and refreshed at a predetermined, recommended rate.

For an LCD display requiring substantial amounts of data, and requiring the data be fetched each time in order to provide the display in a repetitive and cyclical fashion, the data access rate required to support refresh dictates that the data be accessed at higher frequencies than the common crystal rates of 38.4 kilohertz for a paging crystal, or o 32.768 kilohertz a real-time clock (RTC) crystal. The required higher frequencies are synthesized using phase lock loop circuits, or other high frequency clock source. Both the use of phase lock loop circuitry and the retrieval of a substantial amount of data from an external memory increase power consumption requirements of a system, and also increase the overhead cost of a system implementing the circuit as additional circuitry and control information are required. Additionally, a substantial amount of power is consumed by requiring Pixel-based graphical data to be accessed from a memory which is external to the LCD controller and the LCD display. Both the interface between the external memory and the LCD controller as well as the interface between the LCD controller and the LCD display require a significant amount of power to transfer the required data.

Additionally, as previously mentioned, current LCD controllers transfer sufficient data to refresh the entire display irrespective of the amount of information actually being displayed. Such a methodology is efficient if most or all of the display area is used each time the display is activated or enabled. However, when only a portion of the display area is activated or enabled, such methodology proves to be inefficient and consumes power in an inefficient manner. An example of such inefficient power consumption requirement is illustrated when a paging function is added to a digital organizer having a graphical display. Here one line of text might be sufficient to display the contents of the paging operation. The same inefficiency is true of a global positioning system (GPS) where a subset of the data might be all that is required for a substantial percentage of the time when the graphical display is enabled. It is desirable for LCD controllers to compensate for the use of a small portion of an LCD display and avoid using the entire LCD display when only a small percentage of the data space is needed. Additionally, it is desirable to only refresh the desired display area which is a subset of the entire display. It is further desirable to reduce the power required within an LCD display system by providing data only as needed.

BRIEF DESCRIPTION OF THE FIGURES

FIGS. 2–5 illustrate registers associated with one embodiment of the present invention;

DETAILED DESCRIPTION OF THE PRESENT INVENTION

The present invention provides an LCD drive system that reduces the energy consumption in a graphical LCD display area by reducing the area of display to a subset of the graphical LCD display area. The present invention is implemented with a minimal cost in silicon and thus provides an efficient method of LCD display. The present invention is illustrated according to one embodiment of the present invention in FIGS. 1–9.

Figure 1:
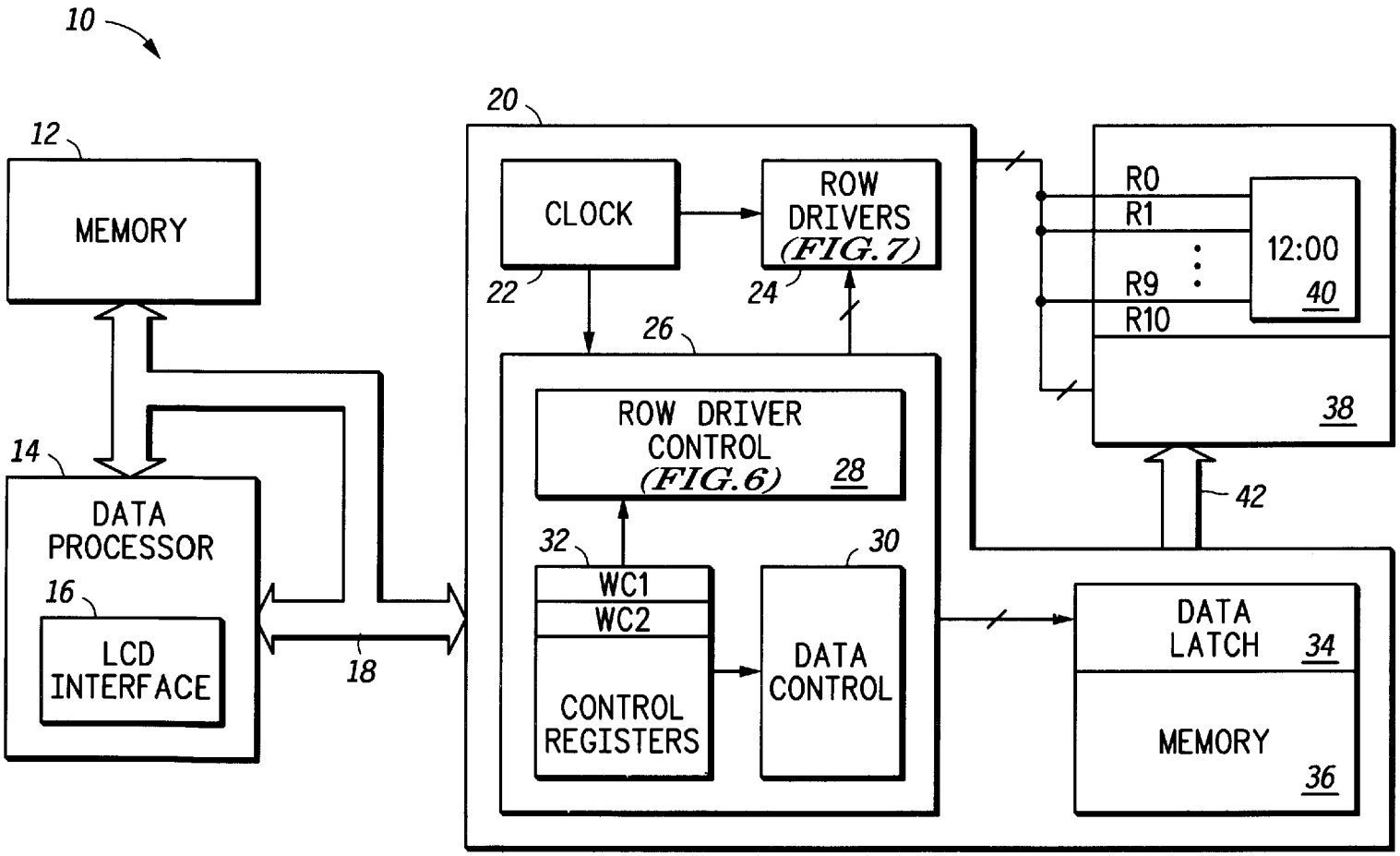
FIG. 1 illustrates, in block diagram form, data processing having LCD controller and interfaces according to one embodiment of the present invention.

FIG. 1 illustrates a data processing system 10, having a memory 12, data processor 14, LCD controller 20, LCD display 38, and interconnecting buses 18 and 42. Data processor 14 includes LCD interface 16. LCD controller 20 includes clock 22, row drivers 24, control block 26, which includes row driver control 28, control registers 32 and data control 30, data latch 34 and memory 36. LCD display 38 includes a subset display 40. Memory 12 is bi-directionally coupled to data processor 14 by way of multiple conductors. Data processor 14 is then coupled to LCD controller by way of bus 18. LCD controller is uni-directionally coupled to LCD display 38 by way of bus 42. Additionally, LCD display 38 is uni-directionally coupled to LCD controller 20 by way of multiple conductors. In the embodiment illustrated in FIG. 1, subset area 40 is a clock display with the present display of 12:00. Subset area 40 is then coupled to LCD controller by way of R0, R1, –R9, R10. Within LCD controller 20, clock 22 is uni-directionally coupled to control block 26. Control block 26 is uni-directionally coupled to row drivers 24 by way of multiple conductors. Clock 22 is uni-directionally coupled to row drivers 24.

Within control block 26, row driver control 28 is uni-directionally coupled to control registers 32. In one embodiment of the present invention, control registers include WC1, WC2. Control registers 32 are uni-directionally coupled to data control 30. Control block 26 is uni-directionally coupled to data latch 34 by way of multiple conductors. Data latch 34 is then contiguous to memory 36, in the embodiment of the present invention illustrated in FIG. 1.

Continuing with FIG. 1, there are two bus interfaces. The first interface or memory bus is between memory 12 and data processor 14. The second bus interface, bus 42, the LCD controller bus, is located between LCD controller 20 and LCD display 38.

The embodiment illustrated in FIG. 1 is a graphical LCD display, also known as a multiplexed LCD. Unlike conventional LCDs, multiplexed LCDs have segments arranged as intersections of rows and columns. Conventional LCDs have separate external connections for each and every segment and descriptor location, plus a common plane. The graphical LCD displays greatly reduce the number of external connections and thus increase potential display density enhancing device reliability. Typically, the rows are called commons and the columns are referred to as segments. The intersection between a common and a segment will be referred to as a segment location.

Unlike other display technologies that respond to peak or average voltage and current, LCDs are sensitive to the root mean square (RMS) voltage across the interplane capacitance at a given segment location. The average voltage across any LCD segment location is to be close to or kept at zero volts. The DC component of the AC signal must also be kept very low, typically less than 100 millivolts. If the DC component rises above a low level, the liquid crystal fluid degrades and the life of the display is greatly reduced. An AC driven display have a typical life expectancy of about 10 years. Whereas, a DC drive display has a life expectancy of several hundred hours.

The method of drive from multiplex displays is essentially a time division multiplex with the number of time divisions equal to twice the number of common planes used. This method allows removal of the DC voltage by inversion of voltage potentials on alternate scans.

Increasing display resolution increases the number of back planes and is time divisions required. Increasing the number of time divisions decreases the percentage of time a "turn on" voltage is applied across each segment location. This translates into a reduction in the RMS voltage applied across each segment location, producing a reduction in contrast. To balance the effect of time multiplexing on the RMS voltage, the "turn on" peak-to-peak voltage applied across each segment location is increased. Note that the switching energy consumed is proportional to the square of the voltage.

The present invention provides a method of LCD display that conserves the energy of the system. Firstly, the bus interfaces 18 and 42 reduce the amount of energy consumed in the system by minimizing the rate and amount of data transfer within the system. By providing a means for minimizing the data to be transferred, the present invention defines a low power mode for a multiplexed LCD display in which only a subset is used, subset area 40, for displaying predetermined information. In various applications, a designer may choose to display time, data or operating information. The type of information displayed in the subset area is dependent upon the application and the flexibility of the user.

Continuing with FIG. 1, subset area 40 may be positioned within LCD display 38 as defined by the user. In one embodiment, subset area 40 is an active LCD window that is currently updated to display data of a predetermined significance. This is effected by way of a low power window location and size register, illustrated in FIG. 2. Low power window location and size register includes 32 bits from zero to 31. According to one embodiment of the present invention, bits zero to 8 are used to store a vertical off-set, defined by bits V0–V8, which are stored in corresponding bit locations of the low power window location and size register. Next, the number of rows to be included in the low power window are represented by bits 11–15. The number of rows corresponds to R0–R4, which are stored in corresponding bit locations from 11–15. The number of columns to be included in the low power window are designated by bits 16–25 with corresponding bits C0–C9. According to the present invention, bits 9, 10, 26, 27, 28, 29, 30, and 31 are set to zero. In alternate embodiments these bits may be used for other purposes associated with the low power window location and size. In still alternate embodiments, these bits may have any number of uses.

FIG. 3 illustrates a register indicating the window data to be displayed in the low power window. Window data register has 32 bits from zero to 31. A starting physical address for the low power window data is stored in window data register. The corresponding bits of address A0–A31 are stored in bit zero through 31, respectively. The physical address stored in window data register as illustrated in FIG. 3 is the starting physical address pointing to the beginning of the message to be displayed.

FIG. 4 illustrates a low power mode control register associated with this embodiment of the present invention. The low power mode control register includes control information for memory update rate, memory enable, black and white enable, low voltage enable, message size indication, low power mode command masks, and message number to be displayed in low power mode. This embodiment of the present invention allows four messages to be displayed. Low power mode control register is a 32-bit register, having bits zero to 31. Memory update rate is stored in bits zero through 6, labeled UR0–UR6 and represents tenths of seconds. Bit 7 is labeled LME and is used to enable memory when in low power mode. Bit 8 is labeled BW and is used to enable the black and white display option when in low power mode. Bit 9 is set to zero, bit 10 is labeled LVE and is used to enable low voltage supply for the LCD display. The message number to be displayed is stored in bits 12–15 labeled MS0–MS3. Bit 16 is labeled CBM and is a low power mode command bit mask. Bit 17 is labeled CPM and is a low power mode command pin mask. Bits 11 and 18–23 are all set to zero. Bits 24–27 are used to store the message number of the message to be displayed in low power mode. The message number is encoded as MN0–MN3. Bits 28–31 are set to zero.

FIG. 5 illustrates a low power command register having 32 bits, zero to 31. The low power command register illustrated in FIG. 5 includes an LPE bit in bit place 0. The LPE bit is used to enable low power mode. All the other bits in low power command register are set to zero. Note that as with all the other registers illustrated in FIGS. 2–5 the bits that are set to zero may be used for other purposes.

Figure 6:
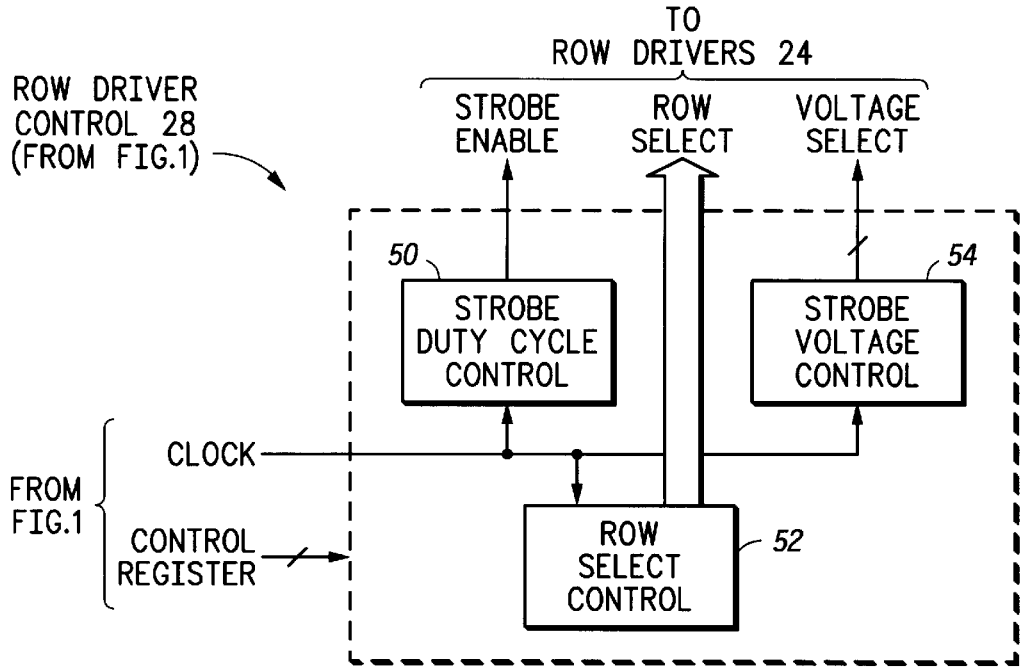
FIG. 6 illustrates a row driver controller from FIG. 1 according to one embodiment of the present invention.

FIG. 6 illustrates a detailed description of row driver control 28 form FIG. 1. Row driver control 28 includes strobe duty cycle control 50, strobe voltage control 54, row select control 52, and conductors for routing a clock signal to strobe duty cycle control 50, row select control 52, and strobe voltage control 54, as well as conductors for providing outputs of a voltage select, a row select, and a strobe enable. The voltage select, row select, and strobe enable are provided to row drivers 24. The clock signal is provided from external to row driver control 28. Note that control registers 32 are coupled to row driver control 28, as in FIG. 1.

Referring to FIG. 6, control information from the control registers 32 of FIG. 1 is provided to row driver control 28. Row driver control 28 is responsive to the information from control register 32 and the clock signal. Row driver control 28 determines the row select signal by way of row select control 52. Row driver control 28 determines the strobe enable signal by way of strobe duty cycle control. Row driver control 28 determines the voltage select signal by way of strobe voltage control 54. The strobe duty cycle allows for a group of common rows to be strobe concurrently, while strobing individual rows that define an active area within subwindow 40 of LCD display 38, as illustrated in FIG. 1, on a row by row basis. The group of common rows are then strobed together, and each of the individual rows are strobed with a unique strobe. The grouping of common row strobes and unique strobes for individual rows is accomplished by the strobe enable signal. In one embodiment of the present invention, the strobe enable signal provides a strobe enable/disable indication for each row of LCD display 38. Alternate embodiments may provide indications for groups of rows, or any other configuration which allows for groups of rows to be strobed together.

Continuing with FIG. 6, the present invention allows different rows to be strobed at different voltage levels. In other words, the present invention provides a row specific, or group specific, voltage assignment. The voltage assignment for active rows may be different than for inactive rows. Further, the programmed voltage levels may be used to effect color or gradient levels in the LCD display 38. The voltage level information is provided by the voltage select signal supplied by strobe voltage control 54. Note that the combination of information from row driver control 28 defines the strobing of the LCD display 38. The row select control indicates the row(s) selected by the row select signal, while the strobe voltage control 54 provides the voltage select signal to indicate the voltage level of the strobe for the row(s), and the strobe duty cycle control 50 provides the strobe enable information which implements the time period for strobing the row(s) selected. Alternate embodiments may include any number of control features coupled to those illustrated in FIG. 6. The present invention provides the means of separating the common rows from the individual rows and thus allowing for reduction in the power consumption of the LCD display 38.

LCD display 38 may display a variety of information while allowing for a small subwindow 40 to display active information while the rest of the display is inactive or low power. The information to be displayed and the conditions which determine the display content and timing are contained in memory 12, and LCD interface 16. The information is provided to LCD controller 20. In one embodiment of the present invention, the information from data processor 14 and memory 12 is provided to LCD controller 20 in the form of coordinates and timing information. This information is then stored in registers, such as those illustrated in FIGS. 2–5. LCD controller 20 then determines the outputs of row driver control 28 of FIG. 6 according to the information stored in the appropriate registers. In this embodiment, LCD controller 20 interprets this information and transforms it to the appropriate row select, voltage select, and strobe enable signals. In an alternate embodiment, data processor 14 determines the values and timing for these signals and provides that information directly in digital or analog form. Still other embodiments incorporate tables of information stored in memory 12, where the information is provided either directly to LCD controller 20 or by way of data processor 14 and LCD interface 16. Row driver control 28 effects the desired display control and provides the signals to row drivers 24, illustrated in detail in FIG. 7.

Figure 7:
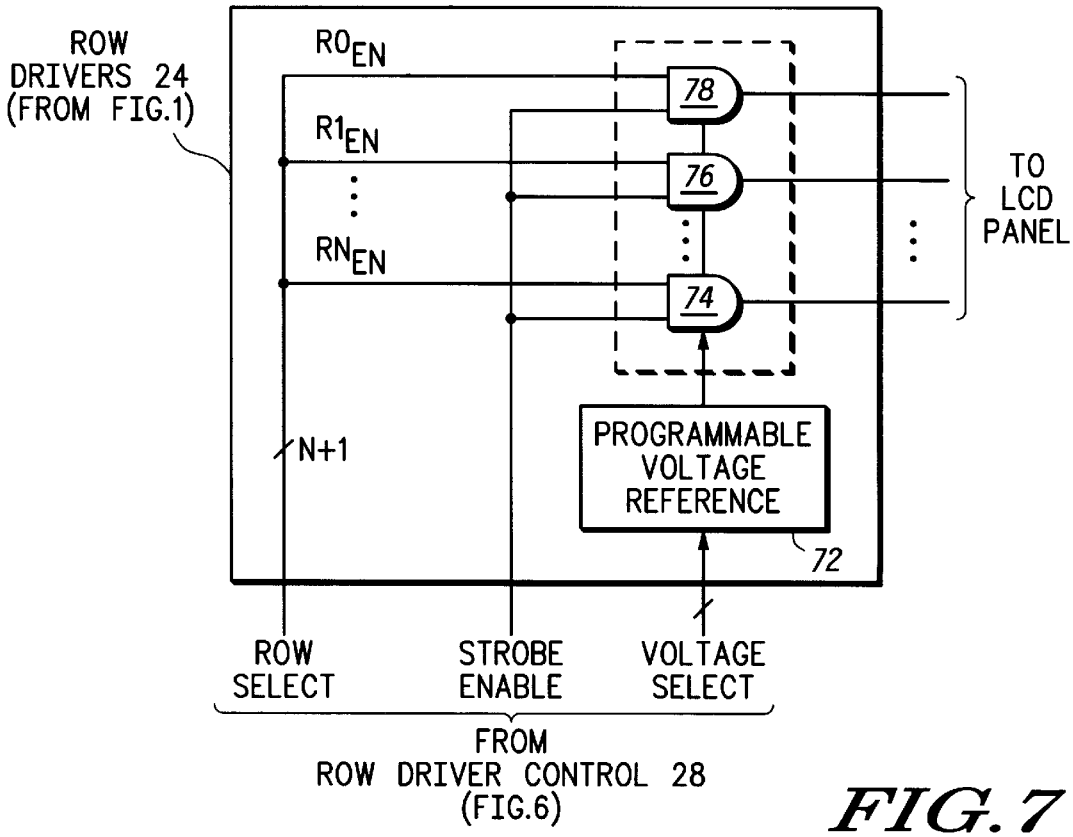
FIG. 7 illustrates row drivers as in FIG. 1 according to one embodiment of the present invention.

FIG. 7 provides a detailed illustration of row drivers 24 from FIG. 1. Row drivers 24 include a programmable voltage reference 72, gates 74–78, inputs from row select, strobe enable, and voltage select, and outputs to the LCD display. Row drivers 24 receive row select, strobe enable, and voltage select from row driver control 28 as illustrated in FIG. 6. Note that FIG. 7 illustrates the logical function of gates 74 through 78, which are represented therein as AND gates. In one embodiment of the present invention gates 74 to 78 also receive a clock input and reference information, where each of gates 74 to 78 is capable of producing multi-level outputs, for example four separate voltage level outputs based on the reference information received from programmable voltage reference 72. Alternate embodiments may implement gates 74 to 78 using other circuitry in keeping with the logical AND function illustrated in FIG. 7, where each gate is controlled by the row select information and the strobe enable signal.

Figure 8:
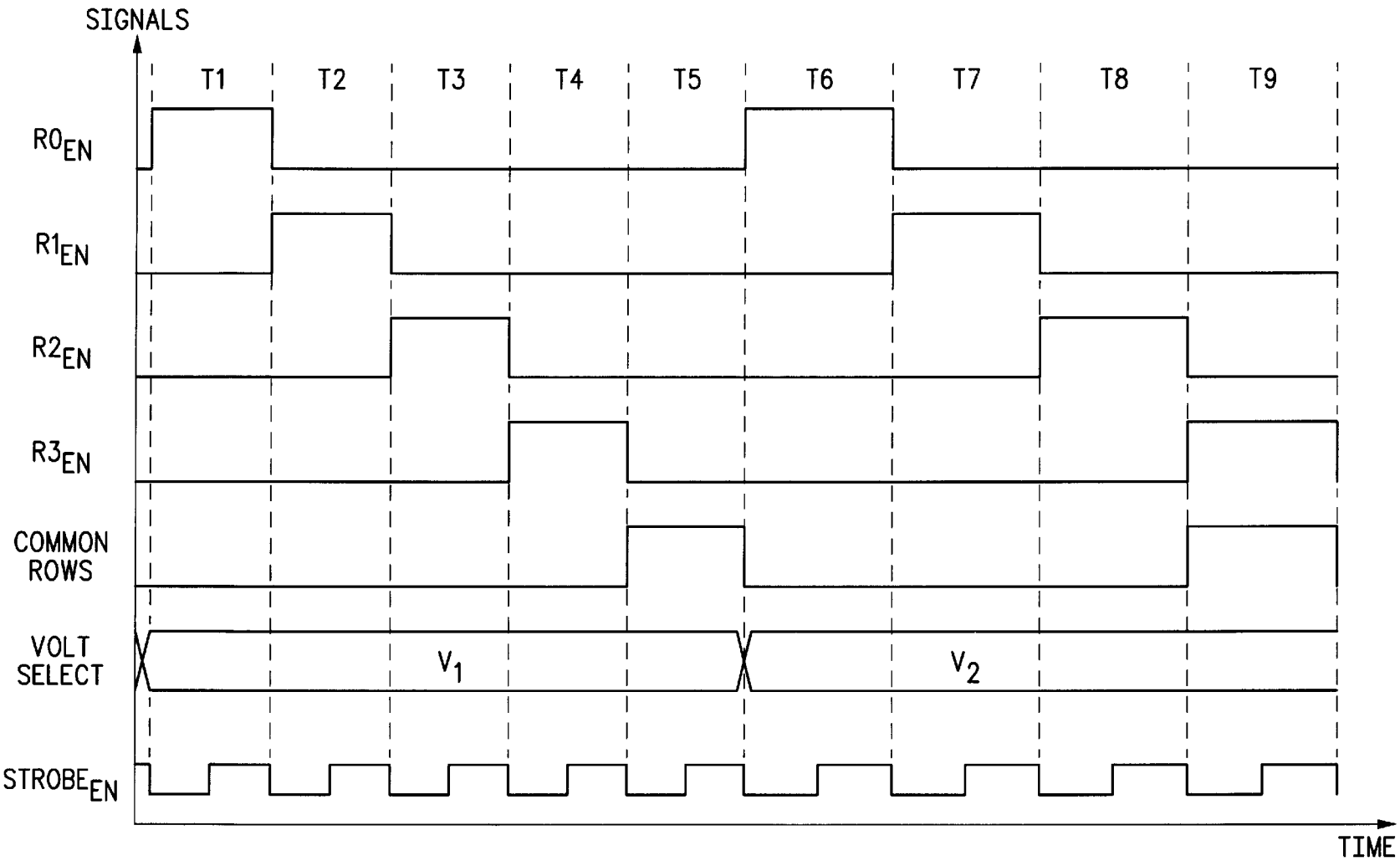
FIGS. 8 and 9 illustrate timing diagrams corresponding to signals provided according to one embodiment of the present invention.

Operation of the row drivers 24 of FIG. 7 is illustrated with reference to the timing diagram of FIG. 8. Specifically, individual row select signals $R0_{EN}$ through $Rn_{EN}$, are driven by row select control 52 of the row driver control 28 and are illustrated in FIG. 8 as $R0_{EN}$ through $R3_{EN}$. Strobe duty cycle control 50 provides voltage select signal. Strobe voltage control 54 provides the strobe enable pulse, which is illustrated in FIG. 8 as the $STROBE_{EN}$ signal. When it is determined that the $R0_{EN}$ is to be driven to LCD display 38, the row select signals are driven such that only the $R0_{EN}$ line is in an active state and the other lines $R1_{EN}$ through $RN_{EN}$ are each in an inactive state illustrated herein as low. Alternate embodiments may incorporate an active high or an active low scheme for enablement. Subsequently, when the strobe enable becomes active, illustrated herein as active high, the gate 78 which is responsive to $R0_{EN}$ then provides an active output to the LCD display. This corresponds to driving row 0. Similarly, gates 76 and 74 provide inactive signals to the LCD display as the respective rows driven by these gates are not selected. Subsequent modifications of the row select signal would allow gates 76 and 74 to provide active signals to the LCD display when both the strobe enable signal and the respective row enable signal are active.

FIG. 7 illustrates a programmable voltage reference portion 72 which receives a voltage select signal. Based upon the voltage select signal, the programmable voltage reference portion 72 provides a voltage reference to the driver portion 70. In other words, the voltage supplied by gates 74, 76, and 78 of the driver portion 70 is determined by the programmable voltage reference portion 72. This is advantageous in that the number of rows containing active data which requires updating determines the voltage needed to properly strobe the LCD 38. As an example, if the LCD display 38 has 100 rows with active date (i.e. to be updated) then for a given time period $T_1$, each row would be allocated $T_1/100$ time units during which that row is driven. The present invention allows multiple rows to be driven together within a single time period. Compare a first situation where all 100 rows are being updated, to the situation illustrated in FIG. 1 where only 11 rows ($R_0$ to $R_{10}$) are being updated. In this situation, it is possible using the present invention to provide a unique strobe to each of the 11 rows, $R_0$ through $R_{10}$, and to provide a single common strobe for the remaining rows $R_{11}$ through $R_{99}$. In this situation, the time available for each strobe would be $T_1/12$, where the time allotted for strobing the common rows is equal to the time allotted to strobing any one of the rows $R_0$ through $R_{10}$. The total number of time units necessary to update LCD display 38 (in this case 12 time units) is the sum of the number of individual rows (in this case 11 rows) and the number of common areas (in this case 1 common area). Proportionately, each of the individual rows is driven for the same amount of time as the common rows are driven simultaneously. This represents a significantly larger amount of time for maintaining each strobe on each row or group of rows. Therefore, a strobe signal having a significantly lower voltage peak can be used in order to obtain the same results. By reducing the rise and fall times associated with large strobe values, it is possible to reduce the overall power requirements of the LCD system, thereby allowing a low power mode of operation when only a portion of an LCD is actively being anticipated.

One example of the usefulness of the present invention in updating common rows together and thus increase the amount of time for strobing individual rows is in displaying a specific icon or menu bar portion of an LCD display, where that portion is the only active display being updated. For example, referring to FIG. 1, a real-time clock value is indicated within the LCD subwindow 40. Therefore, if the remainder of the LCD display is blank, it would be possible to update only the time portion within the subwindow 40 of the LCD display 38 if the remainder of the LCD display is blank. It is possible to update only the clock portion within subwindow 40.

A strobe enable signal, $STROBE_{EN}$, is illustrated in relation to the row select signals and the voltage select signal, VOLTAGE SELECT. The horizontal axis represents time and the vertical axis represents each of the logical signals in an active high or inactive low state. The operation of the system illustrated in FIG. 8 has four rows that are individually updated and a common area of multiple rows. The individual row enable signals are labeled $R0_{EN}$, $R1_{EN}$, $R2_{EN}$, and $R3_{EN}$ and correspond to rows R0, R1, R2, and R3 respectively. The common area enable signal is labeled COMMON ROWS. Note that the common rows may include any number of rows. According to the description of the present invention provided above, there will be 5 time units associated with the operation illustrated in FIG. 8. Each of the individual rows will be allotted a time unit, and the common rows will be allotted one time unit proportionately. For clarity, the time units are indicated across the top of FIG. 8 as $T_1$, $T_2$, $T_3$, $T_4$ and $T_5$.

Continuing with FIG. 8, during a first time period $T_1$, a voltage select signal V1, as illustrated in FIG. 7, is received at programmable voltage reference 72. Upon receiving the voltage select signal, the programmable voltage reference 72 generates a voltage reference signal for driver portion 70 illustrated within the row driver portion 24 of FIG. 7. In the illustrated embodiment, the programmable voltage reference signal is specified in a digital manner to a charge pump or other unit capable of providing a programmable voltage reference controlled in a digital manner. One skilled in the art, however, would recognize that the programmable voltage reference could be modified by other means as well. During the first time period $T_1$ the R0 enable signal is active while the remaining signals are inactive. During a second portion of period $T_1$, the row driver R0 goes active at the specified voltage level, V1, as illustrated in FIG. 9.

Note that the signal R0 strobes the actual LCD window. Subsequent rows R1, R2, R3 and common rows, are selected in the present example during consecutive time periods $T_2$, $T_3$, $T_4$, and $T_5$. Continuing to time period $T_6$, a new voltage reference value $V_2$ is presented by the programmable voltage reference 72. In this case new voltage reference value is the same as the first, i.e. $V_1=V_2$, and the second update of the LCD display begins at time period $T_6$. Note that again strobe voltage control 54 provides the voltage select value needed by the programmable voltage reference 72 of FIG. 7. As illustrated in FIG. 8, time period $T_6$ imitates time period $T_1$, and time period $T_7$ imitates time period $T_2$, etc. Time periods $T_1$ to $T_5$ represent a first cycle of updating for LCD display 38. LCD display 38 is completely updated starting at time period $T_1$ and ending at time period $T_5$. The second cycle then updates LCD display 38 a second time starting at time period $T_6$ and ending at time period $T_9$.

Figure 9:
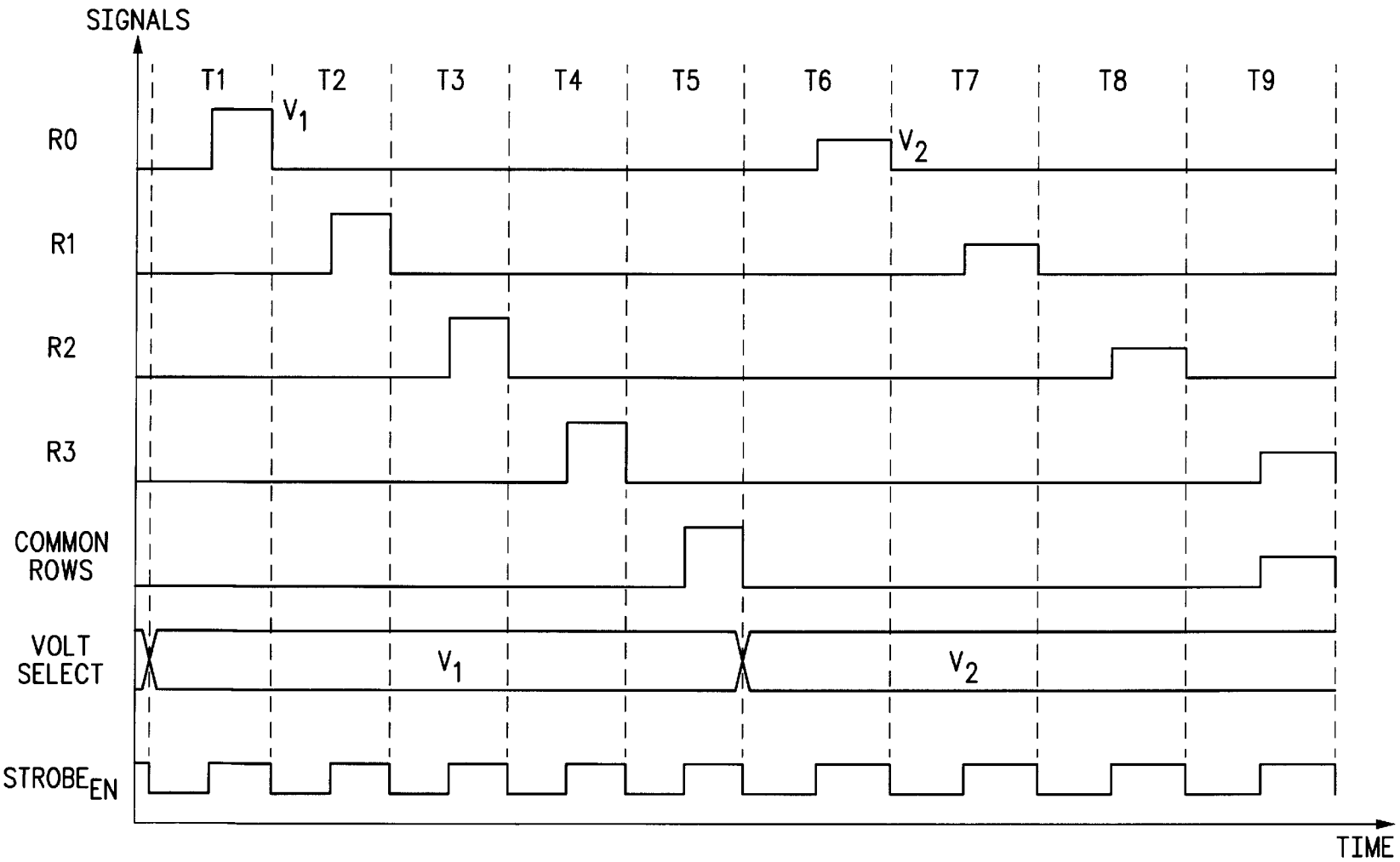

Referring to FIGS. 8 and 9, two low power modes in accordance with the present embodiment are illustrated. The first low power mode is illustrated from $T_1$ to $T_5$, and the second low power mode is illustrated from $T_6$ to $T_{10}$. During the first low power mode, an active area in subwindow 40 includes rows R1 to R3 and the other rows are common rows and not part of subwindow 40. As illustrated in FIG. 8, during the first low power mode, row select $R0_{EN}$ is high during time unit $T_1$, row select $R1_{EN}$ is high during time unit $T_2$, row select $R2_{EN}$ is high during time unit $T_3$, and row select $R3_{EN}$ is high during time unit $T_4$, while the CONMON ROWS select signal, used to select rows R4 through R100 in parallel, is high during time unit $T_5$. Note that in the present embodiment of the invention, as illustrated in FIGS. 8 and 9, the signal logic is active high. Alternate embodiments may incorporate any logical convention for these signals.

In the example illustrated in FIG. 8, during the first low power mode, all of the individual rows and the common rows are at first voltage level designated by VOLTAGE SELECT signal, V1. Additionally, during the second low power mode, all of the individual rows and the common rows are at a second voltage level, V2. Note that in alternate embodiments, each of the individual rows may be driven at separately specified voltage levels, and the common rows may be driven at a distinctly specified voltage level. According to one embodiment of the present invention, each row driver is capable of four distinct voltage levels. The VOLTAGE SELECT signal designates the voltage assignment for each of the row drivers. The configuration of FIGS. 8 and 9 serves as an exemplar of the functionality of one embodiment of the present invention. In alternate embodiments, the number of rows to be displayed may be any subset or subsets of the total number of rows in display 38. Alternate embodiments may drive row R0 at a first voltage level during time unit $T_1$, and R1 at a second different voltage level during time unit $T_2$. The VOLTAGE SELECT signal designates the voltage assignment for each of the row drivers.

During a second power mode, row select $R0_{EN}$ is high during time unit $T_6$, row select $R1_{EN}$ is high during time unit $T_7$, and row select $R2_{EN}$ is high during time unit $T_8$. However, during the second low power mode row select $R3_{EN}$ and the COMMON ROWS select signal are high during time unit $T_9$. For the second low power mode, only three rows of subwindow 40 are active and are to be driven individually. The fourth row, row R3, is now not an active row in subwindow 40 and thus row R3 is to be driven concurrently with the common rows (i.e. is now part of the common rows). In the second low power mode, VOLTAGE SELECT signal indicates a voltage level V2 for all of the rows of display 38.

FIG. 9 illustrates the output of row drivers 24 corresponding to the signals of FIG. 8. Row driver R0 is driven during a portion of time unit $T_1$ at the voltage specified by V1. During the second low power mode, the voltage for row driver R0 is reduced to voltage V2, as illustrated in FIG. 9. FIG. 9 illustrates the voltage level specification of one embodiment is a function of the number of active rows.

FIG. 9 illustrates a transition occurring resulting in a change of the voltage level of the strobe. Again, the signals are labeled on the vertical axis of the drawing and the horizontal axis represents time. Again, the updating of LCD display 38 is broken into the same number of time periods, where rows R0 to R3 are individually strobed and the common rows are strobed together. Starting at time period $T_1$, the voltage reference indicated is $V_1$ at a first value. The same value is used throughout the updating of LCD display 38. At time $T_6$ the voltage reference changes and the value of $V_2$ is not equal to the value of $V_1$. Here the voltage reference has been reduced and is illustrated by the reduced height of signals R0, R, R2, R3, and COMMON ROWS. Unlike the two cycles of updating illustrated in FIG. 8, the case of illustrated in FIG. 9 results in a change in the display at LCD display 38.

As illustrated in FIG. 9, the voltage level V2 is less than the voltage level V1. The voltage drop from the first low power mode to the second low power mode (i.e. V1 to V2), in the present illustration, are a function of the reduced number of active rows in subwindow 40. The voltage required to display subwindow 40 during low power operation is a function of the number of active rows. This allows the power consumption of LCD display 38 to be adjusted to reflect reductions in the size of subwindow 40.

The two cycle patterns illustrated in FIGS. 8 and 9 show the direct effect on the signal outputs of row drivers 24 of changing the reference voltage from programmable voltage reference 72. The signals R0, R1, R2, R3 and COMMON ROWS illustrate the output of gates 74 to 78 provided to LCD display 38. Note that these rows and the placement of the subwindow 40 are illustrated in FIG. 1. The placement of the subwindow 40 is accomplished by the registers illustrated in FIGS. 2 and 3.

In one embodiment the present invention allows additional cycles to specify a different voltage level for each of gates 74 to 78, where the voltage level is selected from one of multiple predetermined levels. Still another embodiment allows the voltage reference to gates 74 to 78 to be proportional to one another based on a predetermined scheme.

The present invention provides a method for driving a multiplexed LCD panel 38, where an LCD controller 20 controls the LCD panel 38 and provides a low power mode which refreshes a subset 40 of the display panel 38 sequentially while refreshing the rest of the panel 38 in parallel. By resolving the panel into these portions, the present invention reduces the power consumption of an LCD module. The common portions to be displayed in parallel and the individual rows corresponding to active data are specified by a row driver control 28 which controls row drivers 24. Row drivers 24 may then directly provide the specified control configuration to LCD panel 38. Display information is stored in a memory 12 and provided to the controller 38 which drives the LCD panel 38. An LCD interface 16 within the data processor 14 effects the controls and specifications needed. The advantage of the present invention is evidenced in the reduction of power consumption associated with an LCD panel and the flexibility of specifying a subwindow 40 for active display, while adjusting the time required to update a portion of the display up to the entire display. The location of the subwindow is easily manipulated and may be placed anywhere within the display and still allow the parallel updating of the inactive portions of the display. These advantages are particularly sensitive for battery operated applications and devices where certain data is critical for continued display.

Further advantages include, a reset signal eliminates fetching and clocking of zeroes for common areas in the display. One embodiment shifts zeroes into the serial shift register for serial strobe of all commons having inactive data display requirements. This eliminates the need for the data processor 14 or the memory 12 to provide data for these rows, as the rows are inactive. The LCD controller determines that the rows are inactive and implements the zero shifts. At the same time, the subwindow 40 active display continues in normal operating mode. This embodiment reduces the need to pass information between the data processor 14, the memory 12 and the LCD controller 20. Another advantage provides a clearing mechanism, which is a reset signal in one embodiment, to fill the serial shift register with zeroes. This feature eliminates the need to fetch and clock in zeroes every time there is a need to clear the shift register and again reduces the effective traffic on the interface between memory 12, data processor 14 and LCD controller 20. This also allows for partial common row displays.

Still further advantages include additional memory within LCD controller 20 for storing local display memory. The local memory storage supports the display of active data in the subwindow 40, which may be an icon, logo, or even cyclically changing information such as a real-time clock, consistent with the energy savings of the present invention. The local provision of data for the subwindow reduces the need to fetch and clock data from external to the LCD controller 20. Additionally, the present invention provides an LCD controller which supports two tone (eg. black and white mode) during low power operating mode. The LCD controller effectively reduces the number of bits per pixel used on the LCD display 38 and thus reduces the number of bits to be stored in and fetched from memory. The LCD controller is flexible in operating with different display modules. Where the display format necessitates a different arrangement, the LCD controller will bit fill accordingly. The bit filling effects a two tone display in spite of the number of pixels used in an active display. By providing the bit fill operations in the LCD controller, again the data transfer from the data processor 14 and the memory 12 are reduced.

Still another advantage is the flexibility of the serial register for shifting data. The serial shift register of the present invention allows data to be shifted from the right to left or conversely from the left to right, in response to the needs of the display data. The directional decision will be based on the position and size of subwindow 40. The bi-directional flexibility of the serial register implemented in one embodiment of the present invention maintains the power consumption minimization consistent with the present invention.

While the present invention has been illustrated and described with reference to specific embodiments, further modifications and improvements will occur to those skilled in the art. For example, although several uses for the present invention have been described herein, there are a wide variety of configurations for a memory storing data for LCD display, a data processor and an LCD controller. For example, alternate embodiments of the present invention may incorporate more functions into the LCD controller with respect to the provision of row strobes consistent with the present invention. Further, an alternate embodiment may incorporate any number of subwindows, or may have a subwindow within a subwindow. Additionally, still other embodiments may use a method of calculating the strobe timing and number of time units for strobing according to some other parameter of LCD operation. These alternate embodiments will be implemented in a manner similar to the embodiments described within the detailed description of the present invention.

It is to be understood, therefore, that this invention is not limited to the particular forms illustrated and that the appended claims cover all modifications that do not depart from the spirit and scope of this invention.

What is claimed is:

1. A liquid crystal display (LCD) driver module, the LCD driver module driving a multiplexed LCD display panel having a plurality of rows and a plurality of columns, the LCD driver module comprising:

a plurality of row drivers coupled to the display panel, the plurality of row drivers having a plurality of output terminals, the plurality of output terminals for providing LCD strobe signals, the plurality of output terminals corresponding to a plurality of LCD rows;

a memory, the memory storing window coordinate information, the window coordinate information defining a display window corresponding to a first set of rows from the plurality of output terminals and a common area corresponding to a second set of rows from the plurality of output terminals;

a row driver control unit coupled to the plurality of row drivers and the memory unit, the row driver control unit providing at least one control signal to the plurality of row drivers according to the window coordinate information; and a shift register where a first data to be displayed is shifted through the shift register in a first direction and a second data to be displayed is shifted through the shift register in a second direction, and wherein the plurality of row drivers provide LCD strobe signals to each row of the first set of rows sequentially and provide LCD strobe signals to the second set of rows in parallel, wherein the LCD strobe signals are provided to each of the first set of rows during a first time period and the LCD strobe signals provided to the second set of rows are provided during a second time period equal to the first time period.

2. An LCD driver module as in claim 1, wherein the at least one control signal comprises a voltage select signal, a row select signal, and a strobe enable signal.

3. An LCD driver module as in claim 1, wherein the module operates in a low power mode when LCD strobe signals are provided to the second set of rows in parallel.

4. An LCD driver module as in claim 3, wherein a supply voltage is provided to the display panel, and wherein the supply voltage is proportional to a number of rows in the second set of rows in parallel.

5. An LCD driver module as in claim 4, wherein the row driver control unit comprises a voltage reference unit, and wherein the voltage reference unit generates the supply voltage.

6. An LCD driver module as in claim 5, wherein the voltage reference unit is a charge pump.

7. An LCD driver module as in claim 5, wherein the voltage reference unit is programmable.

8. An LCD driver module as in claim 1, the LCD driver module further comprising:

a serial shift register, the serial shift register providing display information for common areas of the display panel.

9. An LCD driver module as in claim 8, wherein the serial shift register is filled with a predetermined value for common areas of the display panel.

10. An LCD driver module as in claim 9, wherein the LCD driver module provides a clear signal to fill the serial shift register with zeroes for common areas of the display panel.

11. An LCD driver module as in claim 10, wherein subsequent to providing the clear signal the LCD driver module provides data to the serial shift register corresponding to the display window.

12. An LCD driver module as in claim 8, wherein data is shifted into the serial shift register from left and right ends of the serial shift register.

13. An LCD driver module as in claim 1, wherein the LCD driver module generates a two tone display by repeating data corresponding to each pixel of the display panel.

14. A data processing system, comprising:

a data processor having an LCD interface unit;

an LCD display panel having a plurality of rows and a plurality of columns;

an LCD controller having a plurality of row drivers, the plurality of row driver coupled to the LCD display panel, the plurality of row drivers having a plurality of output terminals, the plurality of output terminals for providing LCD strobe signals, the plurality of output terminals corresponding to a plurality of LCD rows, the LCD controller driving the plurality of rows according to window coordinate information, the LCD controller coupled to the data processor, the LCD controller having a memory, the memory storing the window coordinate information, the window coordinate information defining a display window corresponding to a first set of rows from the plurality of output terminals and a common area corresponding to a second set of rows from the plurality of output terminals, the memory coupled to the data processor;

a data memory storing display data for the LCD display panel; an LCD interface bus coupling the LCD display panel to the LCD controller; and a shift register where a first data to be displayed is shifted through the shift register in a first direction and a second data to be displayed is shifted through the shift register in a second direction; and wherein the plurality of row drivers provide LCD strobe signals to each of the first set of rows sequentially and provide LCD strobe signals to the second set of rows in parallel, wherein the LCD strobe signals are provided to each of the first set of rows during a first time period and the LCD strobe signals provided to the second set of rows are provided during a second time period equal to the first time period.

15. A method for driving a LCD panel, the method comprising the steps of:

determining a first active portion of the LCD panel;

driving a plurality of rows of the first active portion of the LCD panel, wherein the step of driving the plurality of rows of the first active portion of the LCD panel comprises the step of:

providing strobe signals to a first row of the LCD panel, the strobe signals to the first row of the LCD panel having a first characteristic and a second characteristic, the first characteristic having a first value, the second characteristic having a second value;

driving a first plurality of columns of the LCD panel, the first plurality of columns of the LCD panel and the plurality of rows of the LCD panel intersecting to form the first active portion of the LCD panel; and writing data to be displayed in the first active portion to a shift register, the shift register receiving a first data at a first bit position and shifting toward a second bit position, the shift register receiving a second data at the second bit position and shifting toward the first bit position; and wherein the first value of the first characteristic corresponds to a number of rows in the plurality of rows of the first active portion.

16. The method of claim 15, wherein the first characteristic is a supply voltage value.

17. The method of claim 16, wherein the second characteristic is a strobe timing parameter.

18. The method of claim 17, further comprising the step of:

determining a second active portion of the LCD panel;

driving a plurality of rows of the second active portion of the LCD panel, wherein the step of driving the plurality of rows of the second active portion of the LCD panel comprises the step of:

providing strobe signals to a second row of the LCD panel, the strobe signals to the second row of the LCD panel having a first characteristic and a second characteristic, the first characteristic having a third value, the second characteristic having a fourth value; and driving a second plurality of columns of the LCD panel, the second plurality of columns of the LCD panel and the plurality of rows of the LCD panel intersecting to form the second active portion of the LCD panel; and wherein the third value of the first characteristic corresponds to a number of rows in the plurality of rows of the second active portion.

19. The method of claim 15, further comprising the steps of:

writing a first bit of data to be displayed in the first active portion to a first bit location in a memory unit; and writing the first bit of data to be displayed in the first active portion to a second bit location in the memory unit.

20. The method of claim 15, wherein the first value of the first characteristic is selected upon entering a low power mode of operation.

21. A method for controlling an LCD panel, the method comprising the steps of:

determining a first active portion of the LCD panel;

driving a plurality of rows of the first active portion of the LCD panel, wherein the step of driving the plurality of rows of the first active portion of the LCD panel comprises the step of:

providing strobe signals to a first row of the LCD panel, the strobe signals to the first row of the LCD panel having a first characteristic and a second characteristic, the first characteristic having a first value, the second characteristic having a second value;

driving a first plurality of columns of the LCD panel, the first plurality of columns of the LCD panel and the plurality of rows of the LCD panel intersecting to form the first active portion of the LCD panel; and writing data to be displayed in the first active portion to a shift register, the shift register receiving a first data at a first bit position and shifting toward a second bit position, the shift register receiving a second data at the second bit position and shifting toward the first bit position; and wherein the first value of the first characteristic is selected upon entering a low power mode of operation.

22. A method for driving a LCD panel, the method comprising:

determining a first coordinate and a second coordinate corresponding to a first window display of the LCD panel;

providing display data for a first portion of the LCD panel within the first window display;

supplying predetermined data for areas outside the first window display;

providing at least one strobe signal to the first portion of the LCD panel during a first time period;

providing a common strobe signal to the areas outside the first window display during a second time period;

shifting a first display data in a first direction through a shift register;

shifting a second display data in a second direction through the shift register; and wherein a ratio of the first time period to the second time period is a predetermined ratio.

23. A method as in claim 22, wherein the at least one strobe signal includes one strobe signal for each row in the first portion.

24. A method as in claim 23, wherein the ratio is 1:1.

25. A method as in claim 22, wherein the ratio is programmable.

26. A method as in claim 22, wherein the step of supplying predetermined data comprises:

shifting zeroes into a serial shift register, the serial shift register providing data for the second portion of the LCD panel.

27. A method as in claim 23, wherein the step of supplying predetermined data comprises:

providing a clear signal to fill a serial shift register with zeroes.

* * * * *